US011406546B2

(12) United States Patent
Dahbali

(10) Patent No.: US 11,406,546 B2
(45) Date of Patent: Aug. 9, 2022

(54) NONMETALLIC WHEELCHAIR

(71) Applicant: JETWEELS INC., Jamaica, NY (US)

(72) Inventor: Asmahan Dahbali, Jamaica, NY (US)

(73) Assignee: JETWEELS INC., Jamaica, NY (US)

( * ) Notice: Subject to any disclaimer, the term of this patent is extended or adjusted under 35 U.S.C. 154(b) by 357 days.

(21) Appl. No.: 16/474,546

(22) PCT Filed: Jan. 8, 2018

(86) PCT No.: PCT/US2018/012757

§ 371 (c)(1),
(2) Date: Jun. 28, 2019

(87) PCT Pub. No.: WO2019/135772

PCT Pub. Date: Jul. 11, 2019

(65) Prior Publication Data

US 2021/0401640 A1 Dec. 30, 2021

(51) Int. Cl.
*A61G 5/10* (2006.01)
*A61G 5/12* (2006.01)

(52) U.S. Cl.
CPC ..... *A61G 5/10* (2013.01); *A61G 5/1018* (2013.01); *A61G 5/125* (2016.11); *A61G 5/128* (2016.11); *A61G 2203/76* (2013.01)

(58) Field of Classification Search
CPC ..... A61G 5/10; A61G 5/125; A61G 5/127; A61G 5/128; A61G 5/1018; A61G 2203/76
See application file for complete search history.

(56) References Cited

U.S. PATENT DOCUMENTS 3,216,738 A * 11/1965 Bockus ..... A61G 5/10 280/30
3,669,107 A * 6/1972 Posey ..... A61G 5/10 128/870
4,770,432 A 9/1988 Wagner
(Continued)

FOREIGN PATENT DOCUMENTS

EP 3254657 B1 * 12/2018 ..... A61G 5/02
JP 2014108197 A * 6/2014
WO WO-2006026810 A1 * 3/2006 ..... A61G 5/12

OTHER PUBLICATIONS

International Search Report issued in International Application PCT/US2018/012757, dated Mar. 19, 2018, 1 page.

*Primary Examiner* — Tony H Winner
*Assistant Examiner* — Michael R Stabley
(74) *Attorney, Agent, or Firm* — Dilworth IP, LLC

(57) ABSTRACT

A nonmetallic wheelchair including a frame, left and right armrests, a footrest, left and right rear wheels, left and right front wheels, and, left and right handles. The frame includes main left and right panels, aback section, and a seat section. The back section is coupled to the main left and right panels, and to the seat section. The seat section is coupled to the main left and right panels. The left and right armrests are pivotally coupled to the main left and right panels, respectively. The footrest is pivotally coupled to the main left and right panels. The left rear and front wheels are coupled to the main left panel. The right rear and front wheels are coupled to the main right panel. The left and right handles are coupled to the frame. The nonmetallic wheelchair is completely made of transparent nonmetallic materials.

37 Claims, 18 Drawing Sheets

(56) References Cited

U.S. PATENT DOCUMENTS

| | | | | |
|---|---|---|---|---|
| 5,101,536 | A * | 4/1992 | Gabriele | A61G 5/08 16/386 |
| 5,240,276 | A | 8/1993 | Coombs | |
| 6,161,848 | A | 12/2000 | Beumer et al. | |
| 6,315,306 | B1 | 11/2001 | Fernie et al. | |
| 6,338,493 | B1 * | 1/2002 | Wohlgemuth | A61G 5/00 135/66 |
| 6,412,795 | B1 | 7/2002 | Beumer et al. | |
| 6,769,705 | B1 * | 8/2004 | Schlangen | A61G 5/00 280/250.1 |
| 7,832,807 | B2 * | 11/2010 | Shickle | A61G 5/10 297/466 |
| 8,888,118 | B2 | 11/2014 | Paul et al. | |
| 8,967,635 | B2 | 3/2015 | Paul et al. | |
| 9,016,706 | B2 | 4/2015 | Paul et al. | |
| 9,084,710 | B2 | 7/2015 | Paul et al. | |
| 9,198,814 | B2 | 12/2015 | Paul et al. | |
| 9,775,753 | B2 | 10/2017 | Johnson et al. | |
| 10,131,372 | B2 | 11/2018 | Bod | |
| 10,555,855 | B2 | 2/2020 | Johnson et al. | |
| 2004/0084870 | A1 | 5/2004 | Ward et al. | |
| 2008/0041282 | A1 * | 2/2008 | Goschy | A61G 5/1094 108/141 |
| 2008/0265542 | A1 * | 10/2008 | Chong | A61G 5/0816 280/250.1 |
| 2016/0102752 | A1 * | 4/2016 | Yelvington | B62K 11/04 475/269 |

* cited by examiner

NONMETALLIC WHEELCHAIR

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC APPENDIX

Not Applicable

BACKGROUND OF THE INVENTION

Traditional manual wheelchairs are made of metal materials which doesn't fulfill the need of industry where metal is not allowed due to restrictions and security requirements. The present invention is a nonmetallic wheelchair that meets industry requirements. Novel and innovative features of the present invention includes transparency and fully nonmetallic made wheelchair. Preferably, the material used is transparent polycarbonate plastic which has acceptable physical and mechanical properties. The present invention may be utilized in different applications which include, but are not limited to, airports, swimming pools, bathing, and hospitals. Presently, metal detectors are utilized in airports, bus depots, train stations, and many buildings, wheelchair using passengers and visitors must get out of and arise from their wheelchair to allow security personnel to perform manual checks for security purposes. Passengers using wheelchairs have to undergo manual inspection and must be moved to another wheelchair after the security checkpoint. The process takes time and effort, but the present invention simplifies and eases travelling procedures. For the airport example, this security check process causes delays to flights and makes airports congested with long queues. Additionally, passengers who use wheelchairs feel discriminated due to the process of security checks. The present invention satisfies the need to avoid discrimination and to avoid delays of flights. The present invention will also reduce the costs associated with the extra time and manpower required by airport security that screens wheelchair using passengers.

For swimming pools, bathing, and other wet and humid areas, the present invention is advantageous over traditional wheelchairs, as the nonmetallic wheelchair will not rust and corrode in these environments. The present invention may also be utilized in hospitals and other institutions where metal objects are not allowed. For example, most hospitals use Magnetic Resonance Imaging (MRI) equipment and the traditional wheelchairs may interfere with the MRI equipment, whereas the present invention may be utilized safely with MRI equipment.

BRIEF SUMMARY OF THE INVENTION

An object of the present invention is a nonmetallic wheelchair comprising a frame, a left armrest, a right armrest, a footrest, a left rear wheel, a right rear wheel, a left front wheel, a right front wheel, a left handle, and, a right handle. The frame comprises a main left panel, a main right panel, a back section, and, a seat section. The back section is coupled to the main left panel, the main right panel, and the seat section. The seat section is coupled to the main left panel and the main right panel. The left armrest is pivotally coupled to the main left panel. The right armrest is pivotally coupled to the main right panel. The footrest is pivotally coupled to the main left panel and to the main right panel. The left rear wheel is coupled to the main left panel. The right rear wheel is coupled to the main right panel. The left front wheel is coupled to the main left panel. The right front wheel is coupled to the main right panel. The left handle is coupled to the frame. The right handle is coupled to the frame. The frame, the left armrest, the right armrest, and the footrest are made of a first nonmetallic material.

In yet another object of the present invention, the nonmetallic wheelchair further comprises a seatbelt, a seatbelt buckle, a seatbelt adjuster, a kneestrap, a kneestrap buckle, and a kneestrap adjuster. The seatbelt buckle and the seatbelt adjuster are adapted to adjust the seatbelt to secure a user to the nonmetallic wheelchair. The kneestrap buckle and the kneestrap adjuster are adapted to adjust the kneestrap to secure the user to the nonmetallic wheelchair. The seatbelt buckle, the seatbelt adjuster, the kneestrap buckle, and the kneestrap adjuster are made of a second nonmetallic material.

In another object of the present invention, the nonmetallic wheelchair further comprises a baggage tray. The baggage tray is pivotally coupled to the main left panel and to the main right panel. The baggage tray is made of a third nonmetallic material.

In yet another object of the present invention, the nonmetallic wheelchair further comprises a braking mechanism. The braking mechanism comprises a lever, a connector rod, and, a braking pad. The lever is pivotally coupled to the connector rod. The connector rod is coupled to the braking pad. The lever pivots between a locked position and a released position. The braking mechanism is made of a fourth nonmetallic material. The braking pad is in contact with the left rear wheel when the lever is in the locked position.

In another object of the present invention, the nonmetallic wheelchair further comprises a second braking mechanism. The second braking mechanism comprises a second lever, a second connector rod, and, a second braking pad. The second lever is coupled to the second connector rod. The second connector rod is coupled to the second braking pad. The second lever pivots between a second locked position and a second released position. The second braking mechanism is made of a fifth nonmetallic material. The second braking pad is in contact with the right rear wheel when the second lever is in the second locked position.

In yet another object of the present invention, the left rear wheel, the right rear wheel, the left front wheel, the right front wheel, the left handle, and the right handle are made of a sixth nonmetallic material.

In another object of the present invention, the nonmetallic wheelchair further comprises a plurality of radial ball bearings. The plurality of radial ball bearings are made of a seventh nonmetallic material.

In yet another object of the present invention, the nonmetallic wheelchair further comprises a left grip and a right grip. The left grip is coupled to the left handle. The right grip is coupled to the right handle. The left grip and the right grip are made of an eighth nonmetallic material.

In another object of the present invention, the frame further comprises a left tipping lever and a right tipping lever.

In yet another object of the present invention, the nonmetallic wheelchair is configured to be stackable. The frame further comprises a left rubber stopper and a right rubber stopper.

In another object of the present invention, the frame further comprises at least one support rod.

In another object of the present invention, each of the first, second, third, fourth, fifth, sixth, seventh and eighth nonmetallic material is selected from the group consisting of polycarbonate, rubber, clear rubber, wood, carbon fiber, thermoplastics, clear polycarbonate, tinted polycarbonate, ultraviolet resistant polycarbonate, methyl methacrylate, glass, transparent composites, glass fibers, resins, transparent fiber-reinforced composites, transparent plastic polymers, general purpose polystyrene, styrene acrylonitrile, styrene methyl methacrylate, poly(methyl methacrylate), and combinations thereof.

In yet another object of the present invention, each of the first, second, third, fourth, fifth, sixth, seventh and eighth nonmetallic material is polycarbonate.

In another object of the present invention, the polycarbonate is transparent.

In yet another object of the present invention, the eighth nonmetallic material is clear rubber.

In another object of the present invention, the clear rubber is transparent.

BRIEF DESCRIPTION OF THE SEVERAL VIEWS OF THE DRAWING

The advantages and features of the present invention will be better understood as the following description is read in conjunction with the accompanying drawings, wherein.

DETAILED DESCRIPTION OF THE INVENTION

Figure 1:
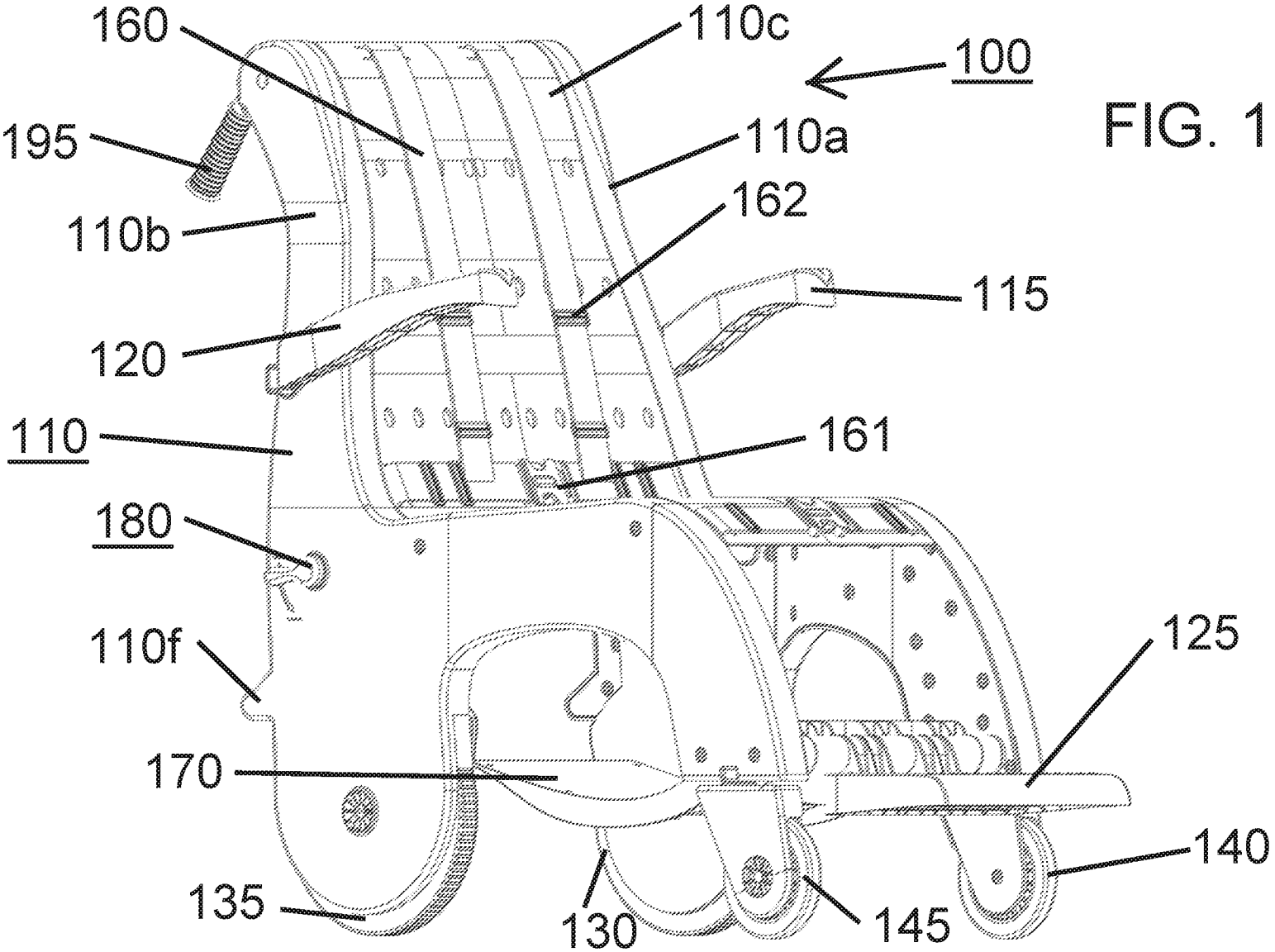
FIG. 1 is a perspective view of an embodiment of the present invention.

The figures illustrate embodiments of the present, wherein a nonmetallic wheelchair 100 which comprises a frame 110, a left armrest 115, a right armrest 120, a footrest 125, a left rear wheel 130, a right rear wheel 135, a left front wheel 140, a right front wheel 145, a left handle 150, and a right handle 155. The frame 110 comprises a main left panel 110*a*, a main right panel 110*b*, a back section 110*c*, and a seat section 110*d*. The back section 110*c* is coupled to the main left panel 110*a*. The back section 110*c* is also coupled to the main right panel 110*b*. The back section 110*c* is further coupled to the seat section 110*d*. The seat section 110*d* is coupled to the main left panel 110*a*. The seat section 110*d* is also coupled to the main right panel 110*b*.

The left armrest 115 is pivotally coupled to the main left panel 110*a*. The right armrest 120 is pivotally coupled to the main right panel 110*b*. The left armrest 115 and the right armrest 120 are illustrated in FIGS. 1-6 and 9 in a position to allow a user to rest her arms. Either one or both of the left armrest 115 and the right armrest 120 may be pivoted towards the top of the back section 110*c*, where the left armrest 115 and the right armrest 120 may be in a position to provide more comfort and room for the user's sides.

The footrest 125 is pivotally coupled to the main left panel 110*a* and to the main right panel 110*b*. The left rear wheel 130 is coupled to the main left panel 110*a*. The right rear wheel 135 is coupled to the main right panel 110*b*. The left front wheel 140 is coupled to the main left panel 110*a*. The right front wheel 145 is coupled to the main right panel 110*b*. The left handle 150 is coupled to the frame 110. The right handle 155 is coupled to the frame 110. The footrest 125 may optionally include a folding mechanism to allow the footrest 125 to folded out of the way, thereby allowing the user to place her feet on the ground.

Figure 14:
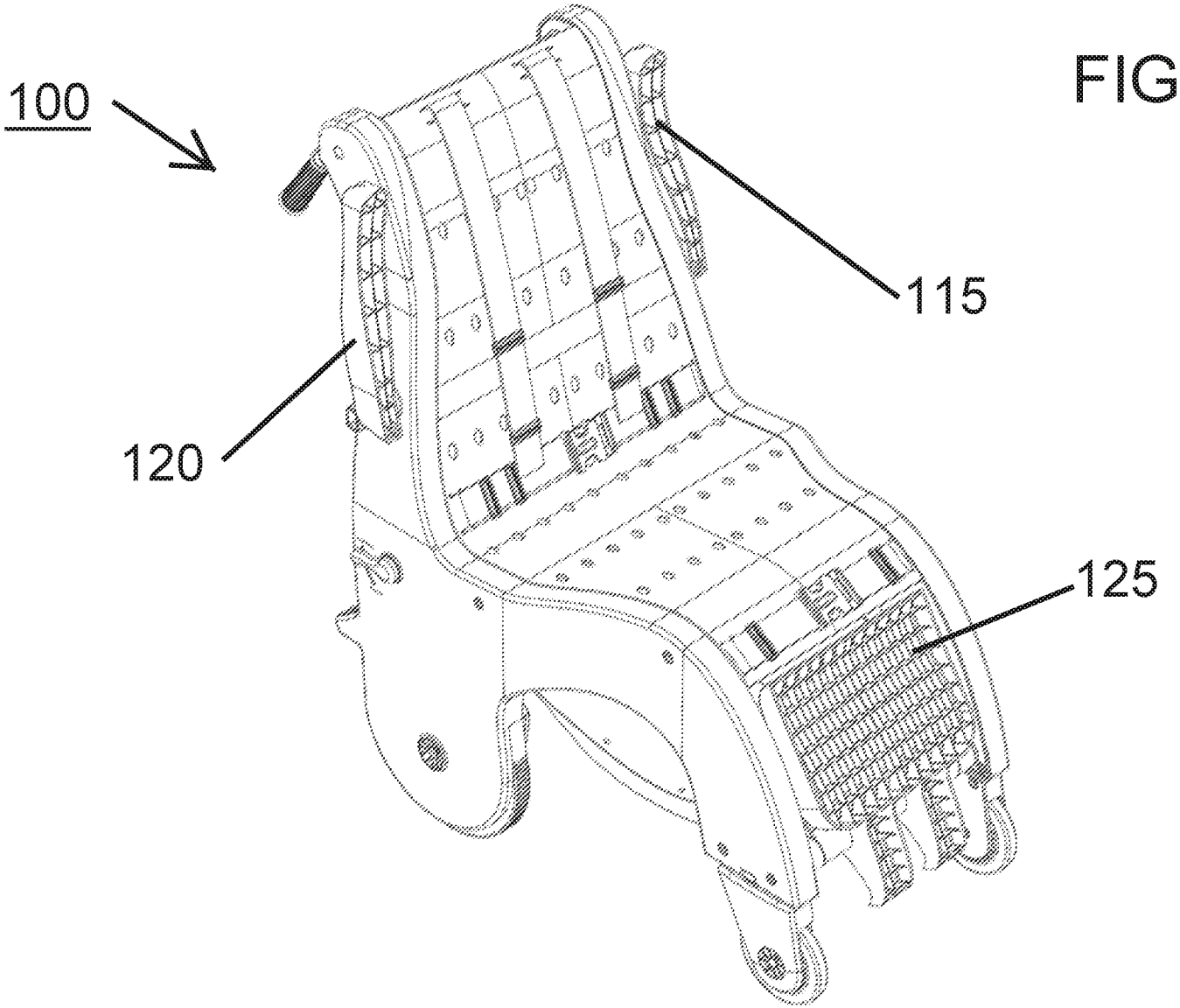
FIG. 14 is a perspective view of an embodiment of the present invention.
Figure 15:
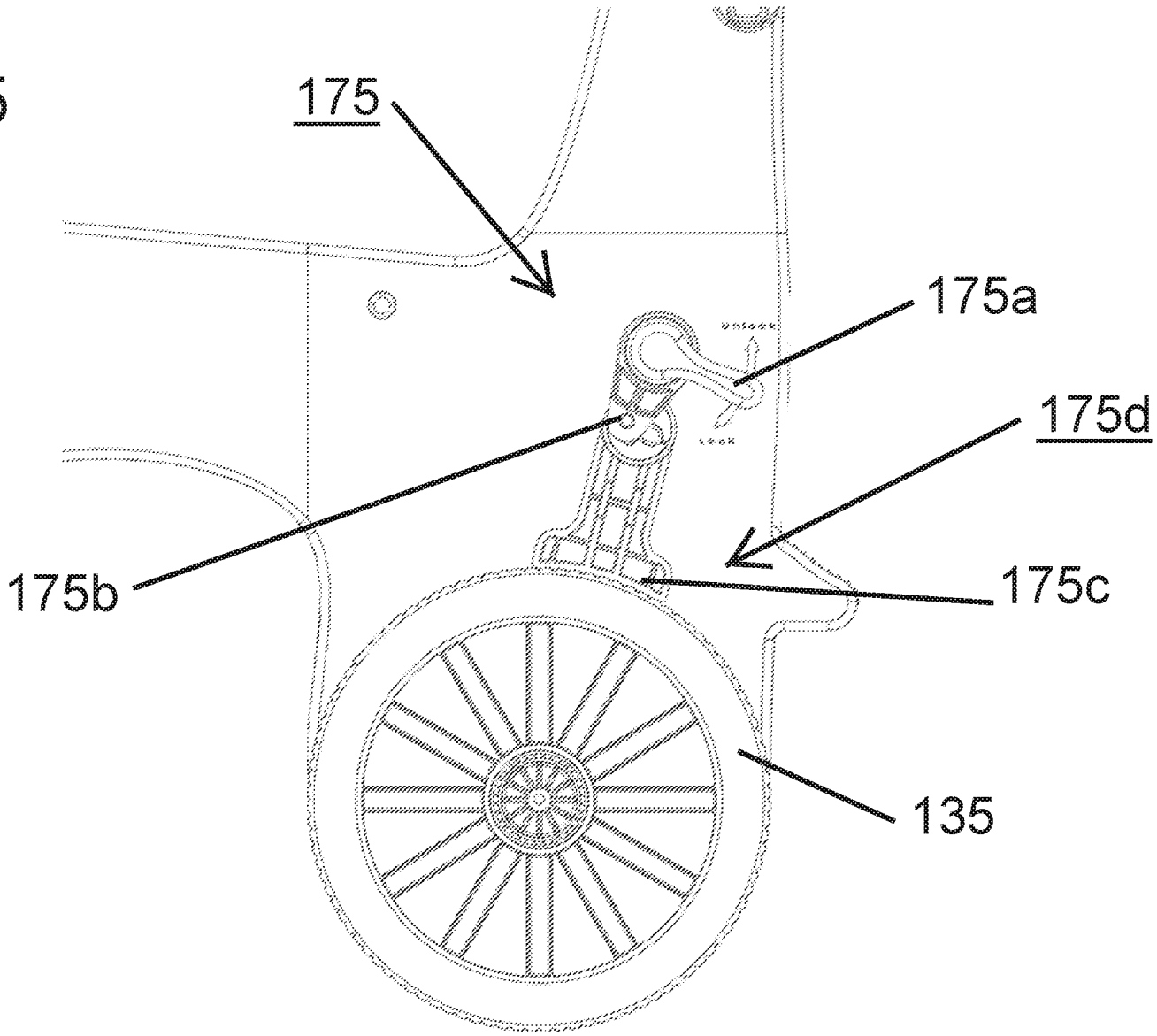
FIG. 15 is a perspective view of an embodiment of the braking mechanism of the present invention.
Figure 16:
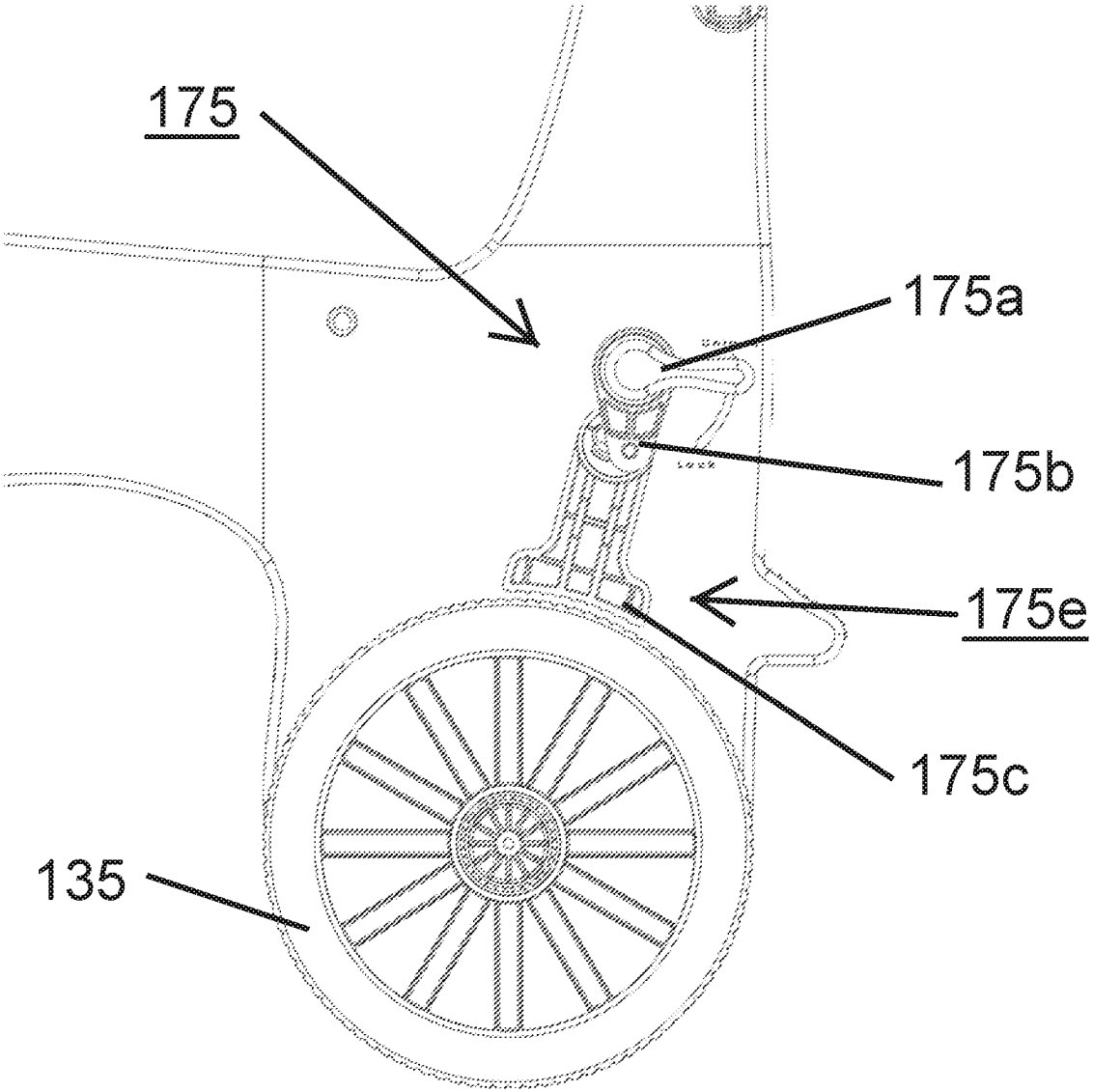
FIG. 16 is a perspective view of an embodiment of the braking mechanism of the present invention.
Figure 17:
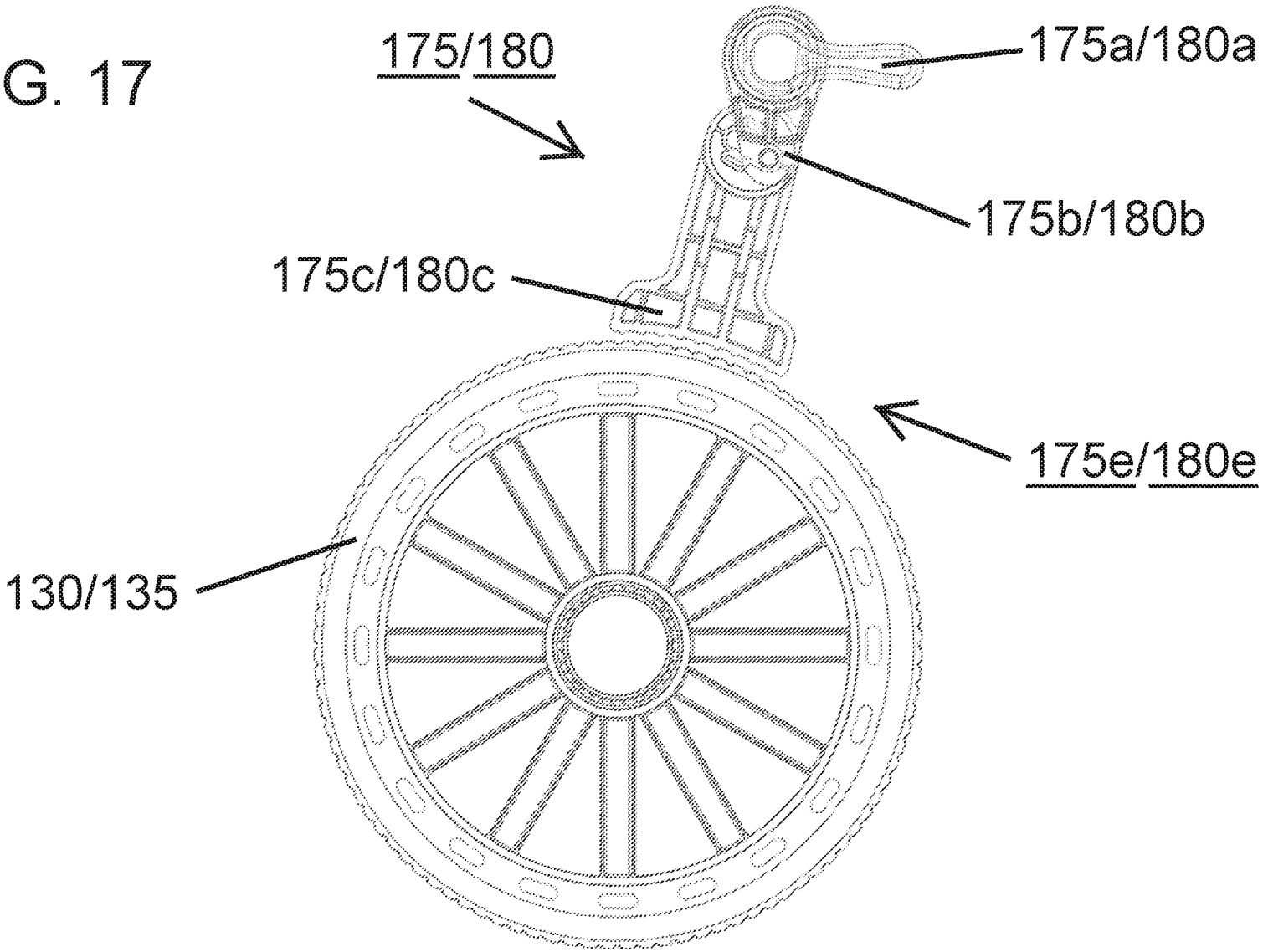
FIG. 17 is a perspective view of an embodiment of the braking mechanism of the present invention.
Figure 18:
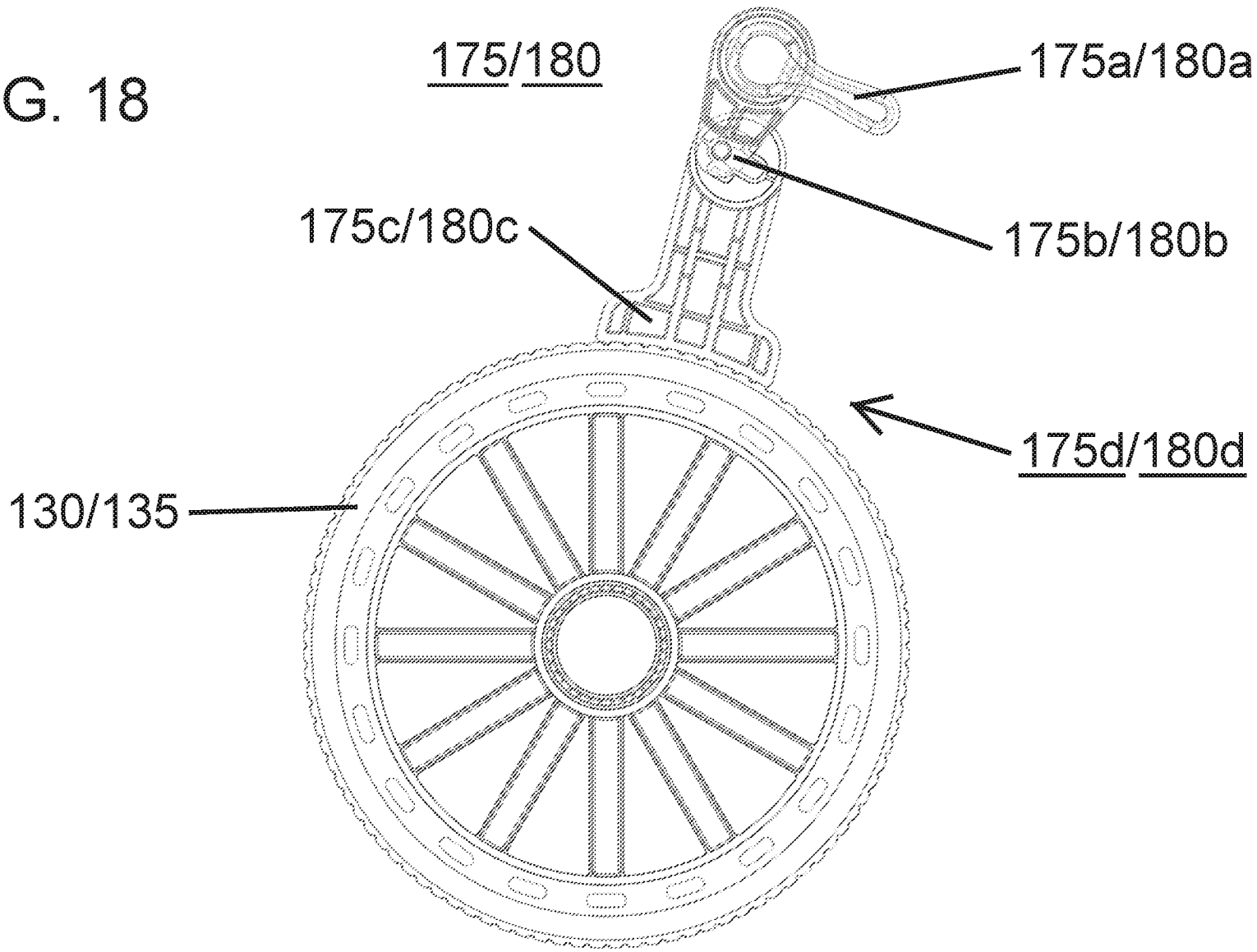
FIG. 18 is a perspective view of an embodiment of the braking mechanism of the present invention.

The left armrest 115, the right armrest 120 and the footrest 125 are illustrated in the upward pivoted position in FIG. 14. Although the figure illustrates all three in the upward pivoted position, each may be pivoted independently from the others. For example, for the comfort of the user, the left armrest 115 may be pivoted in the upward position, while the right armrest 120 may be pivoted in the downward position.

The frame 110, the left armrest 115, the right armrest 120, and the footrest 125 are made of a first nonmetallic material.

Figure 2:
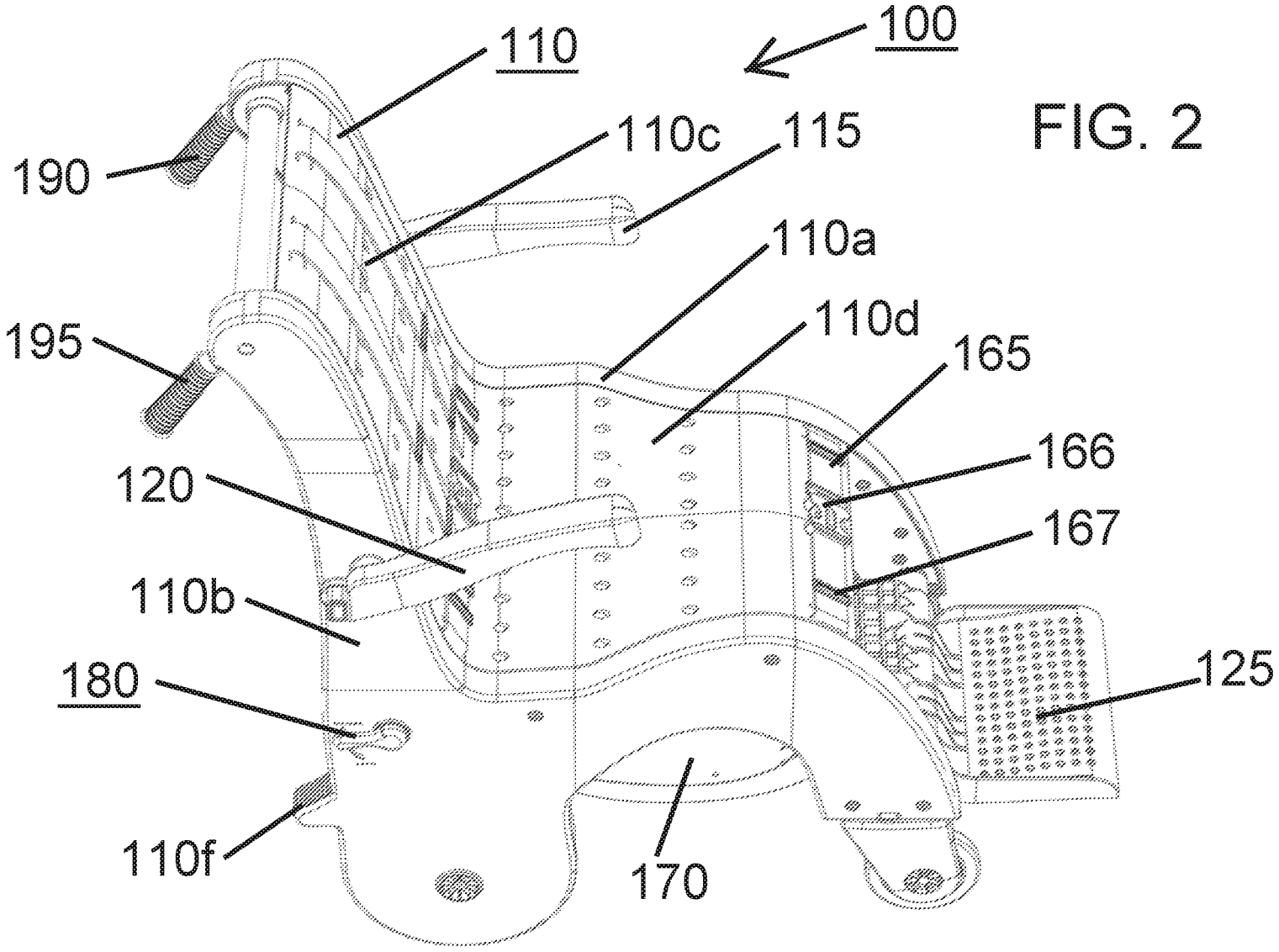
FIG. 2 is a perspective view of an embodiment of the present invention.

In some embodiments, the nonmetallic wheelchair 100 further comprises a seatbelt 160, a seatbelt buckle 161, and a seatbelt adjuster 162, as illustrated in FIG. 1. Some embodiments may have more than one seatbelt adjuster 162. Seatbelt adjusters 162 may be included to adjust the seatbelt 160 to fit and secure the user into the nonmetallic wheelchair 100. The seatbelt buckle 161 may be adapted to adjust the seatbelt 160 to secure the user to the nonmetallic wheelchair 100. In some embodiments, the nonmetallic wheelchair 100 may further comprise a kneestrap 165, a kneestrap buckle 166, and a kneestrap adjuster 167, as illustrated in FIG. 2. Some embodiments have more than one kneestrap adjuster 167. Kneestrap adjusters 167 may be included to adjust the kneestrap 165 to fit and secure the user into the nonmetallic wheelchair 100. The kneestrap buckle 166 may be adapted to adjust the kneestrap 160 to secure the user to the nonmetallic wheelchair 100. The seatbelt buckle 161, the seatbelt adjusters 162, the kneestrap buckle 166, and the kneestrap adjusters 167 may be made of a second nonmetallic material. The seatbelt 160 and the kneestrap 165 may be made of a transparent meshed fabric.

In other embodiments, the nonmetallic wheelchair 100 may further comprise a baggage tray 170. The baggage tray 170 is pivotally coupled to the main left panel 110*a* and to the main right panel 110*b*. The baggage tray 170 is made of a third nonmetallic material. The baggage tray 170 may be utilized to store the user's personal effects and belongings, such as carry-on bags. Furthermore, the baggage tray 170 may add to the structural integrity of the nonmetallic wheelchair 100.

In other embodiments, the nonmetallic wheelchair 100 may further comprise a braking mechanism 175. As illustrated in FIGS. 15-18, the braking mechanism 175 comprises a lever 175*a*, a connector rod 175*b*, and a braking pad 175*c*. The lever 175*a* is pivotally coupled to the connector rod 175*b*. The connector rod 175*b* is coupled to the braking pad 175*c*. The lever 175*a* pivots between a locked position 175*d* and a released position 175*e*. The braking mechanism 175 may be controlled by either the user in the nonmetallic wheelchair 100 or any person assisting the user or pushing the nonmetallic wheelchair 100. The braking mechanism 175 is made of a fourth nonmetallic material. The braking pad 175*c* is in contact with the left rear wheel 130 when the lever 175*a* is in the locked position 175*d*.

In other embodiments, the nonmetallic wheelchair 100 may further comprise a second braking mechanism 180. The second braking 180 mechanism comprises a second lever 180*a*, a second connector rod 180*b*, and a second braking pad 180*c*. The second lever 180*a* is coupled to the second connector rod 180*b*. The second connector rod 180*b* is coupled to the second braking pad 180*c*. The second lever 180*a* pivots between a second locked position 180*d* and a second released position 180*e*. The second braking mechanism 180 may be controlled by either the user in the nonmetallic wheelchair 100 or any person assisting the user or pushing the nonmetallic wheelchair 100. The second braking mechanism 180 is made of a fifth nonmetallic material. The second braking pad 180*c* is in contact with the right rear wheel 135 when the second lever 180*a* is in the second locked position 180*d*.

In some embodiments, the left rear wheel 130, the right rear wheel 135, the left front wheel 140, the right front wheel 145, the left handle 150, and the right handle 155 are made of a sixth nonmetallic material.

Figure 7:
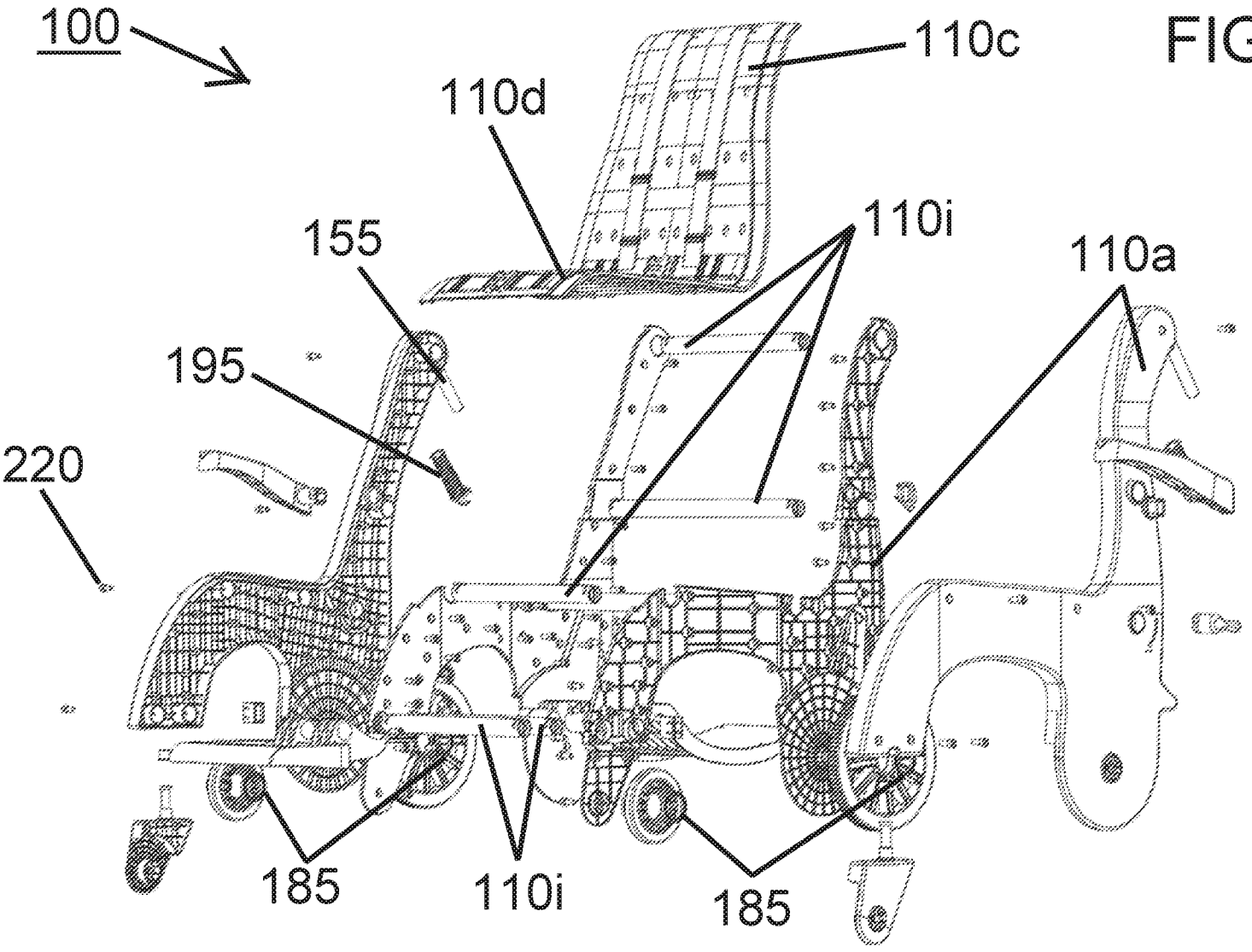
FIG. 7 is an exploded view of an embodiment of the present invention.
Figure 8:
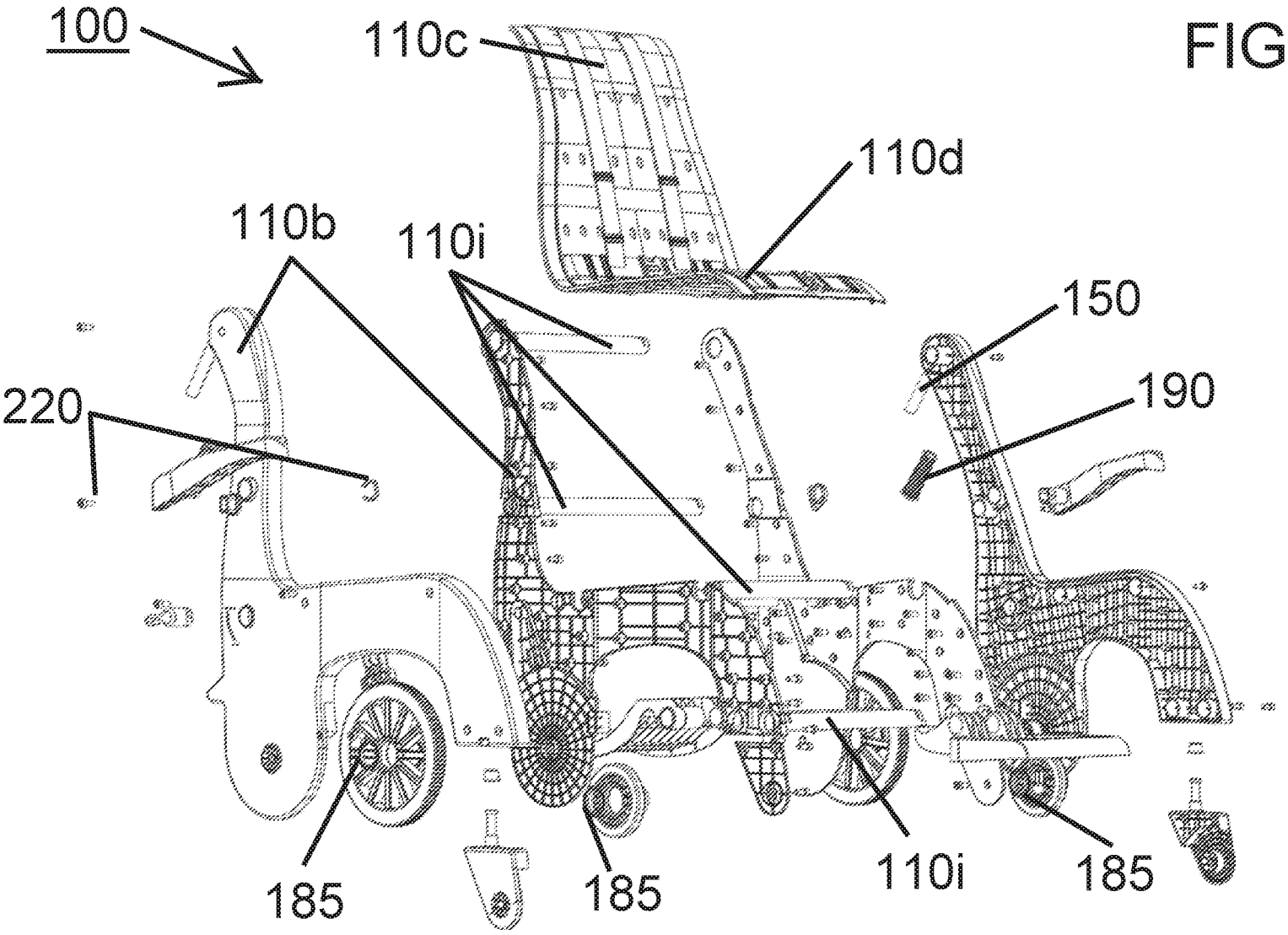
FIG. 8 is an exploded view of an embodiment of the present invention.

In some embodiments, the nonmetallic wheelchair 100 may further comprise a plurality of radial ball bearings 185, as illustrated in FIGS. 7 and 8. The plurality of radial ball bearings 185 are made of a seventh nonmetallic material. The plurality of radial ball bearings 185 makes driving, handling and maneuvering of the nonmetallic wheelchair 100 easier, better and smoother. The plurality of radial ball bearings 185 also reduce rotational friction and support radial and axial loads. The plurality of radial ball bearings 185 may also facilitate the coupling of the left rear wheel 130 and left front wheel 140 to the main left panel 110*a* and the coupling of the right rear wheel 135 and right front wheel 145 to the main right panel 110*b*.

In other embodiments, the nonmetallic wheelchair 100 may further comprise a left grip 190 and a right grip 195. The left grip 190 is coupled to the left handle 150. The right grip 195 is coupled to the right handle 155. The left grip 190 and the right grip 195 may be contoured or ridged to allow a person that pushing the nonmetallic wheelchair 100 to have a better hold on the left handle 150 and the right handle 155. The left grip 190 and the right grip 195 are made of an eighth nonmetallic material.

Figure 3:
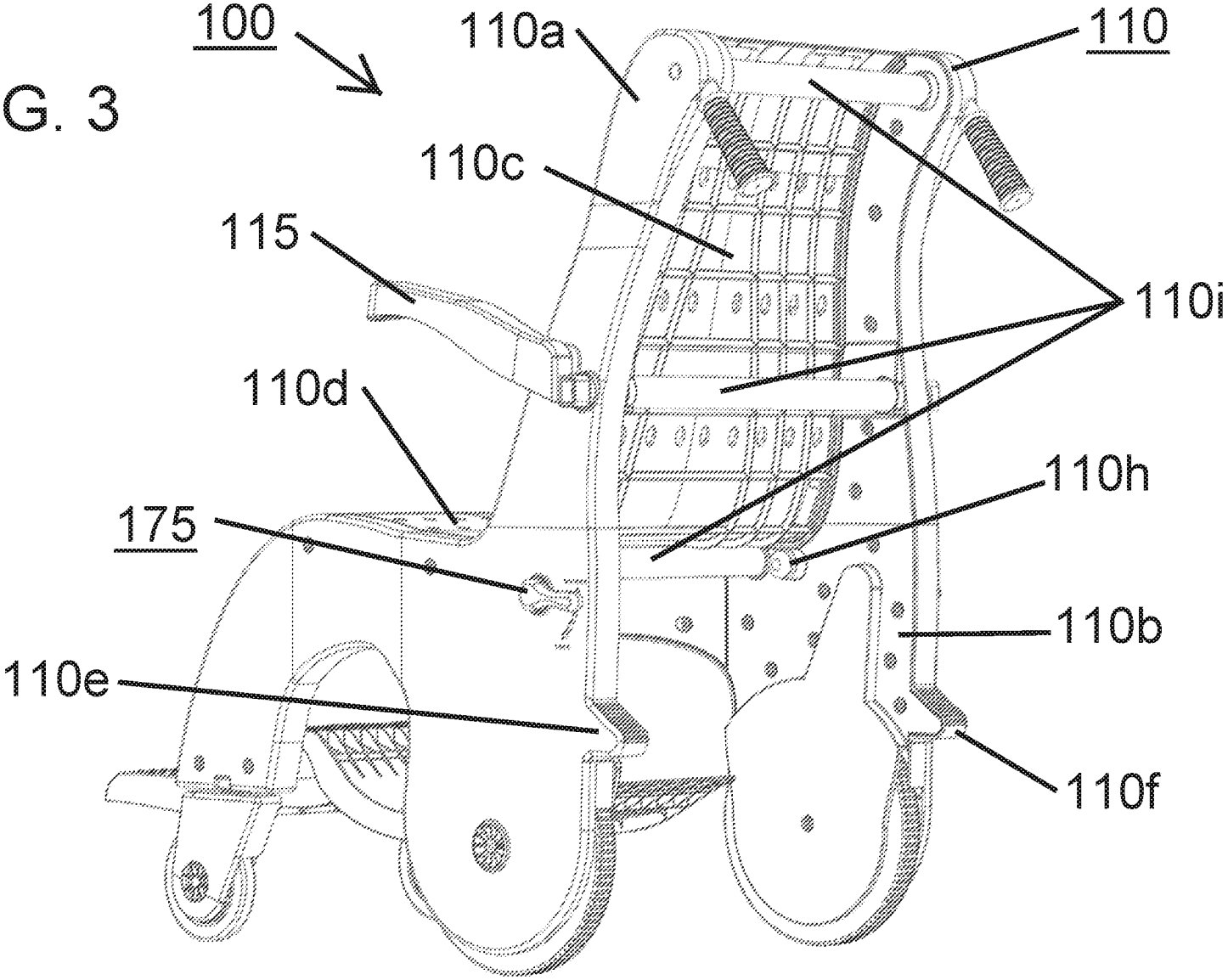
FIG. 3 is a perspective view of an embodiment of the present invention.
Figure 4:
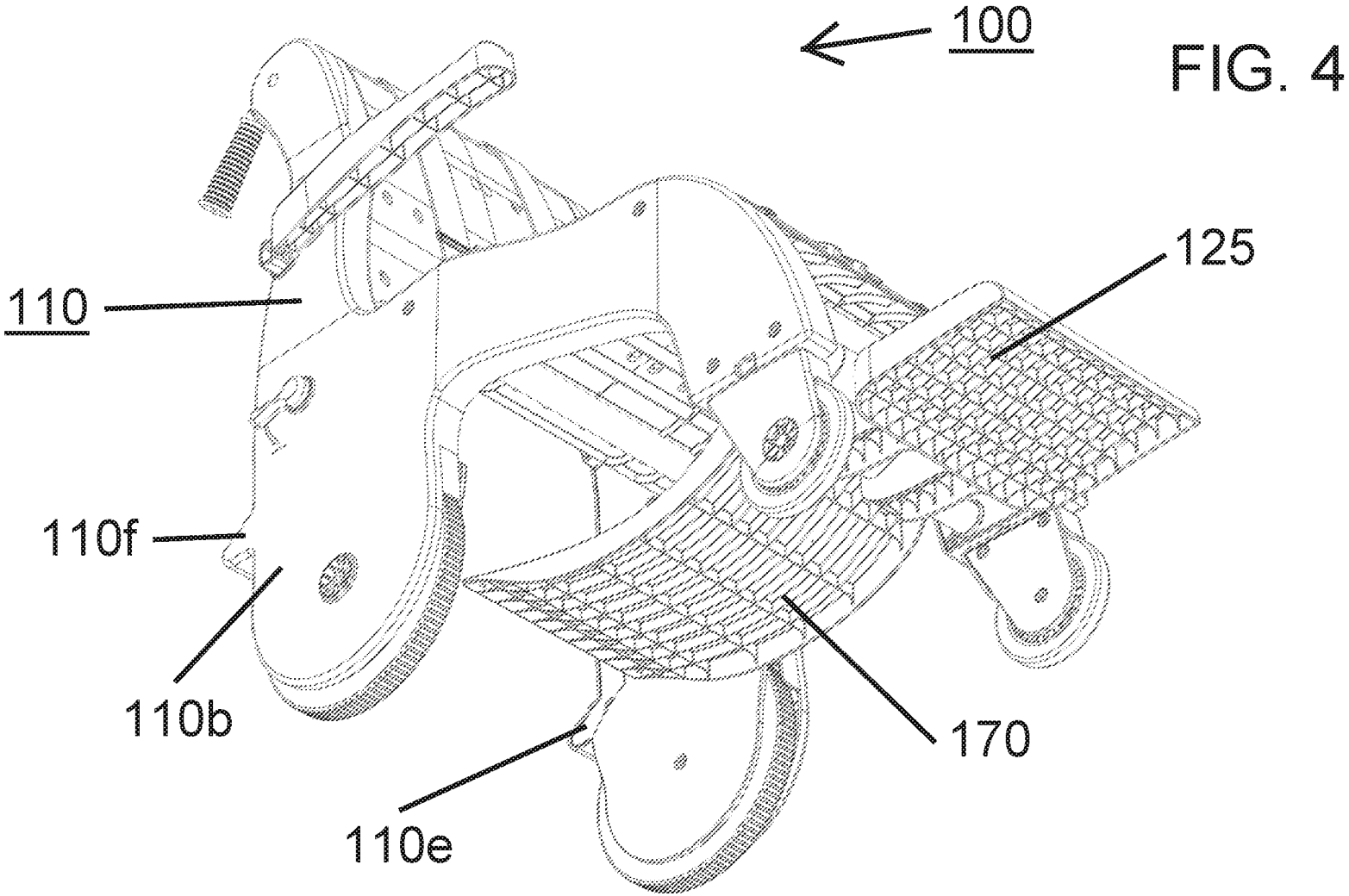
FIG. 4 is a perspective view of an embodiment of the present invention.
Figure 5:
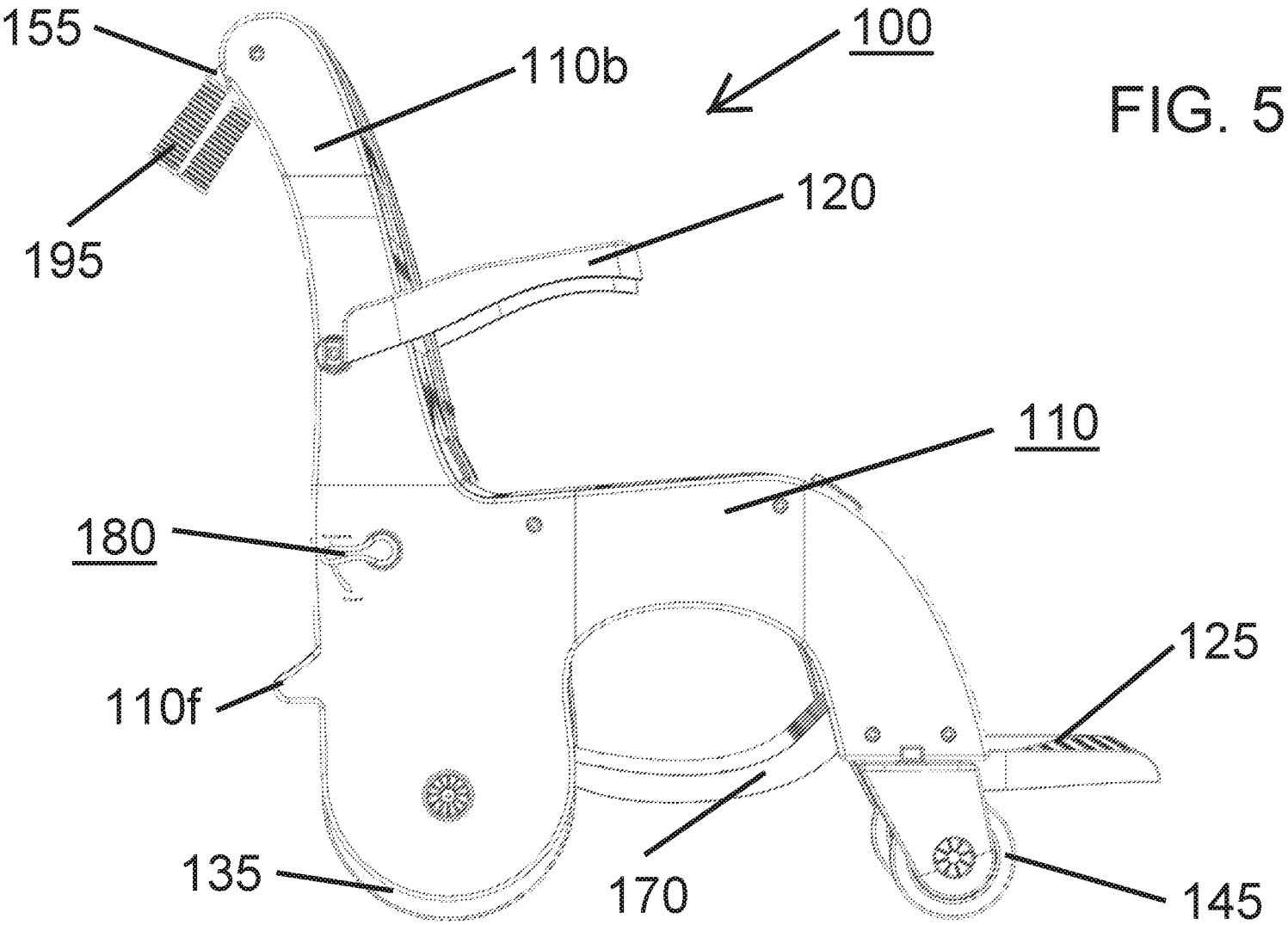
FIG. 5 is a right side view of an embodiment of the present invention.
Figure 6:
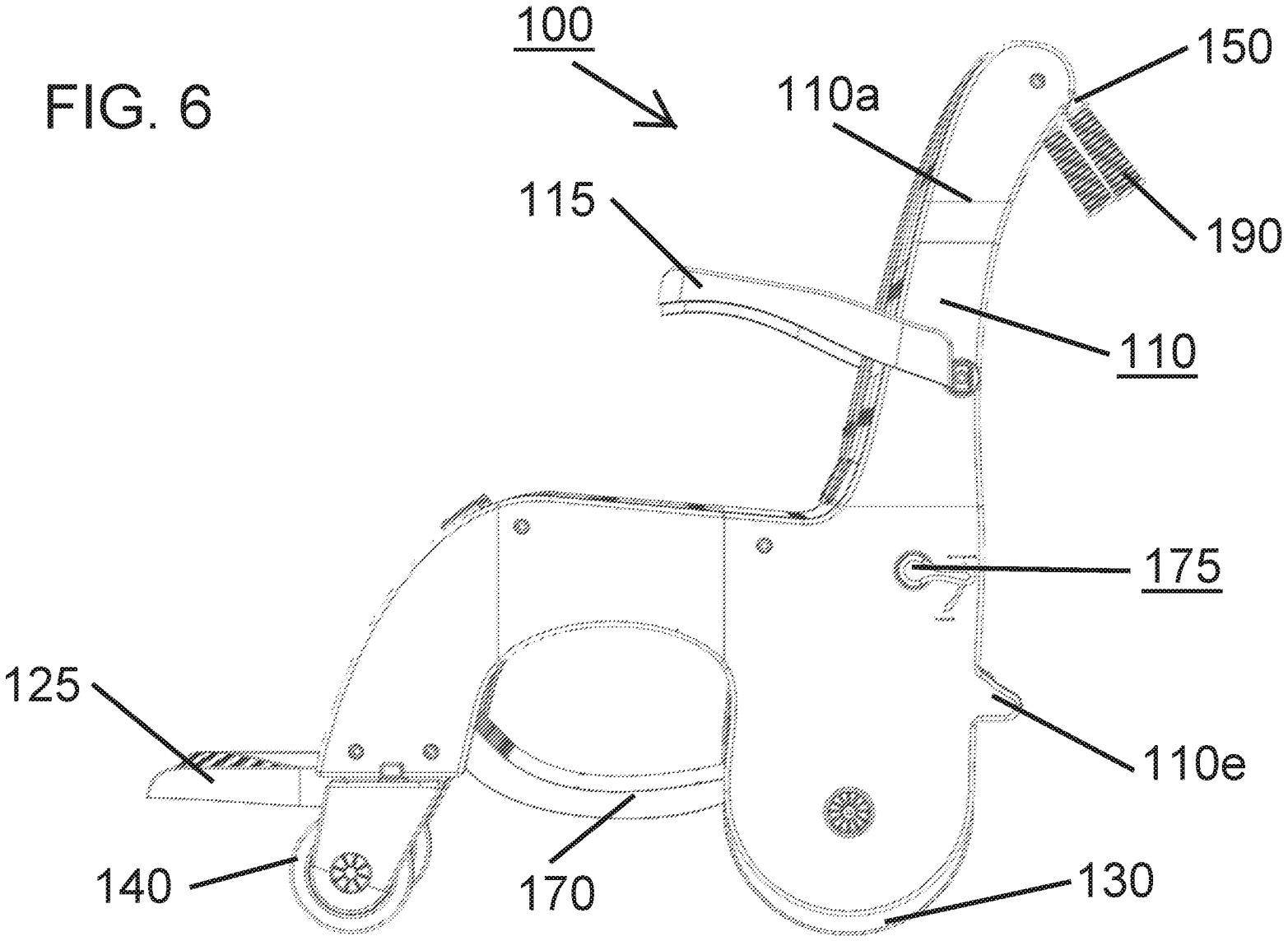
FIG. 6 is a left side view of an embodiment of the present invention.
Figure 9:
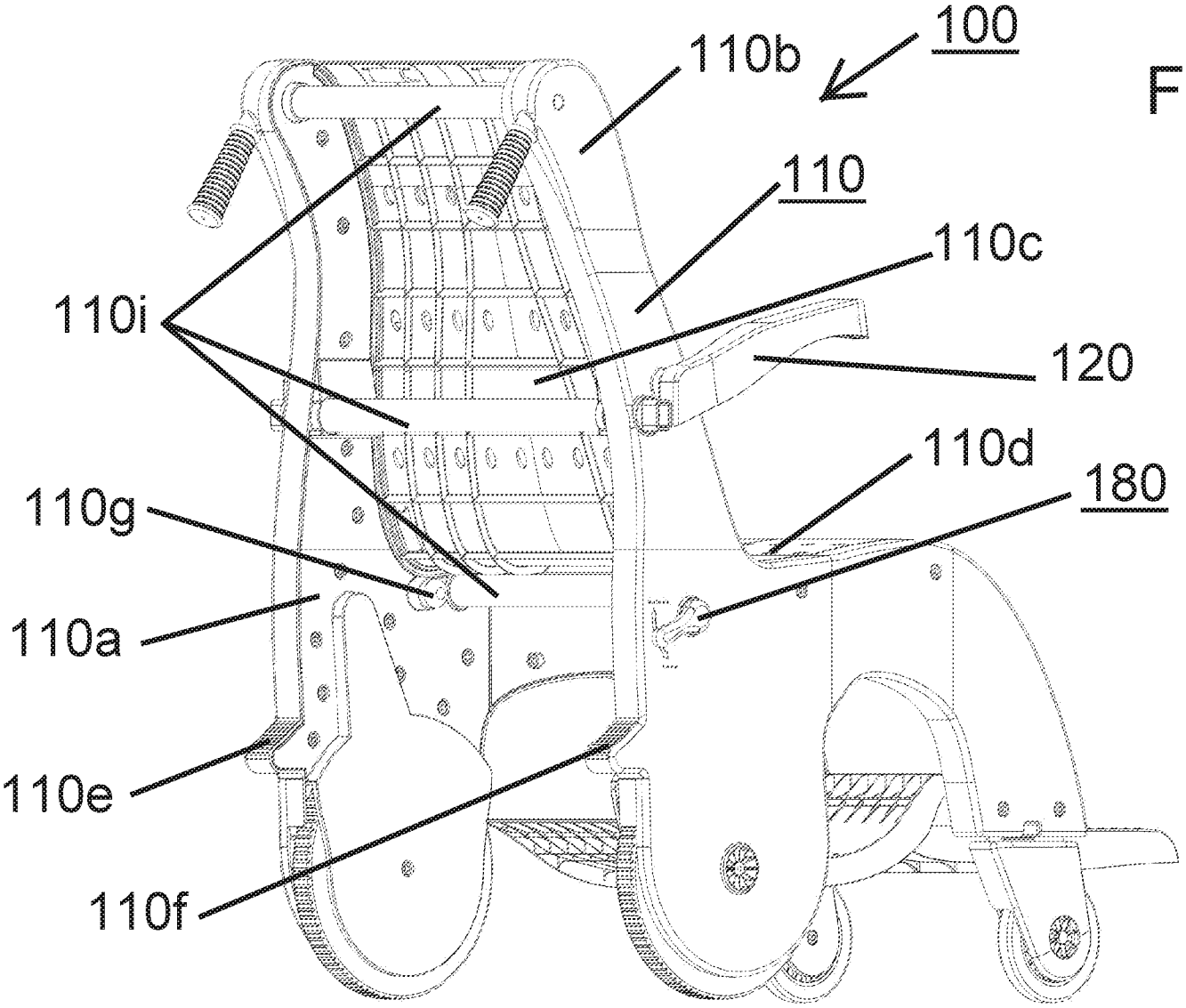
FIG. 9 is a perspective view of an embodiment of the present invention.

In some embodiments, the nonmetallic wheelchair 100 may further comprise a left tipping lever 110*e* and a right tipping lever 110*f*, as illustrated in FIGS. 3 and 9. A driver, who is pushing the nonmetallic wheelchair 100, may use her foot to apply pressure on either the left tipping lever 110*e* or the right tipping lever 110*f* to facilitate tipping the nonmetallic wheelchair 100 backwards. Tipping the nonmetallic wheelchair 100 may be beneficial in certain situations, such as when maneuvering over a curb.

Figure 10:
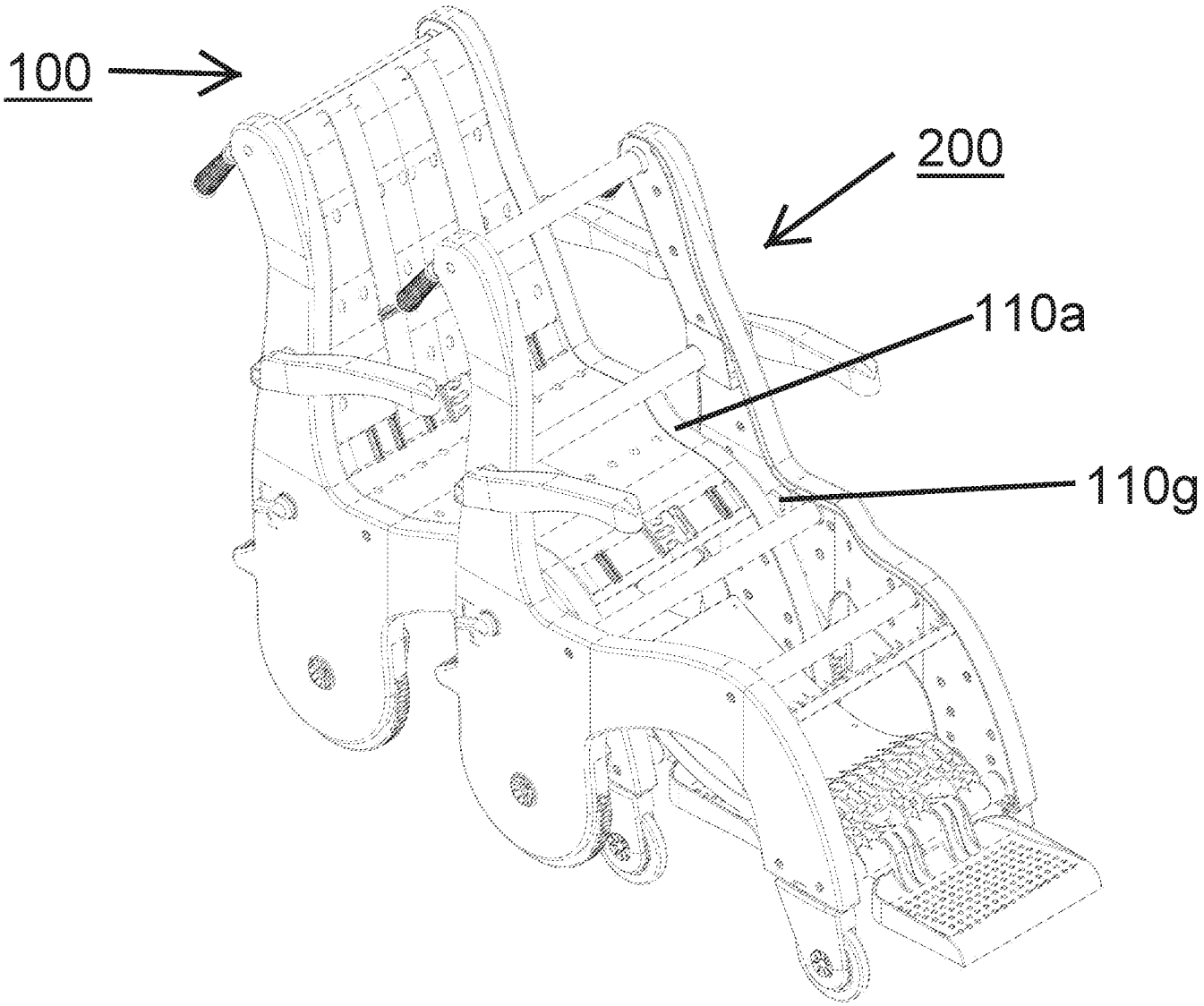
FIG. 10 is a perspective view of an embodiment of the present invention.
Figure 13:
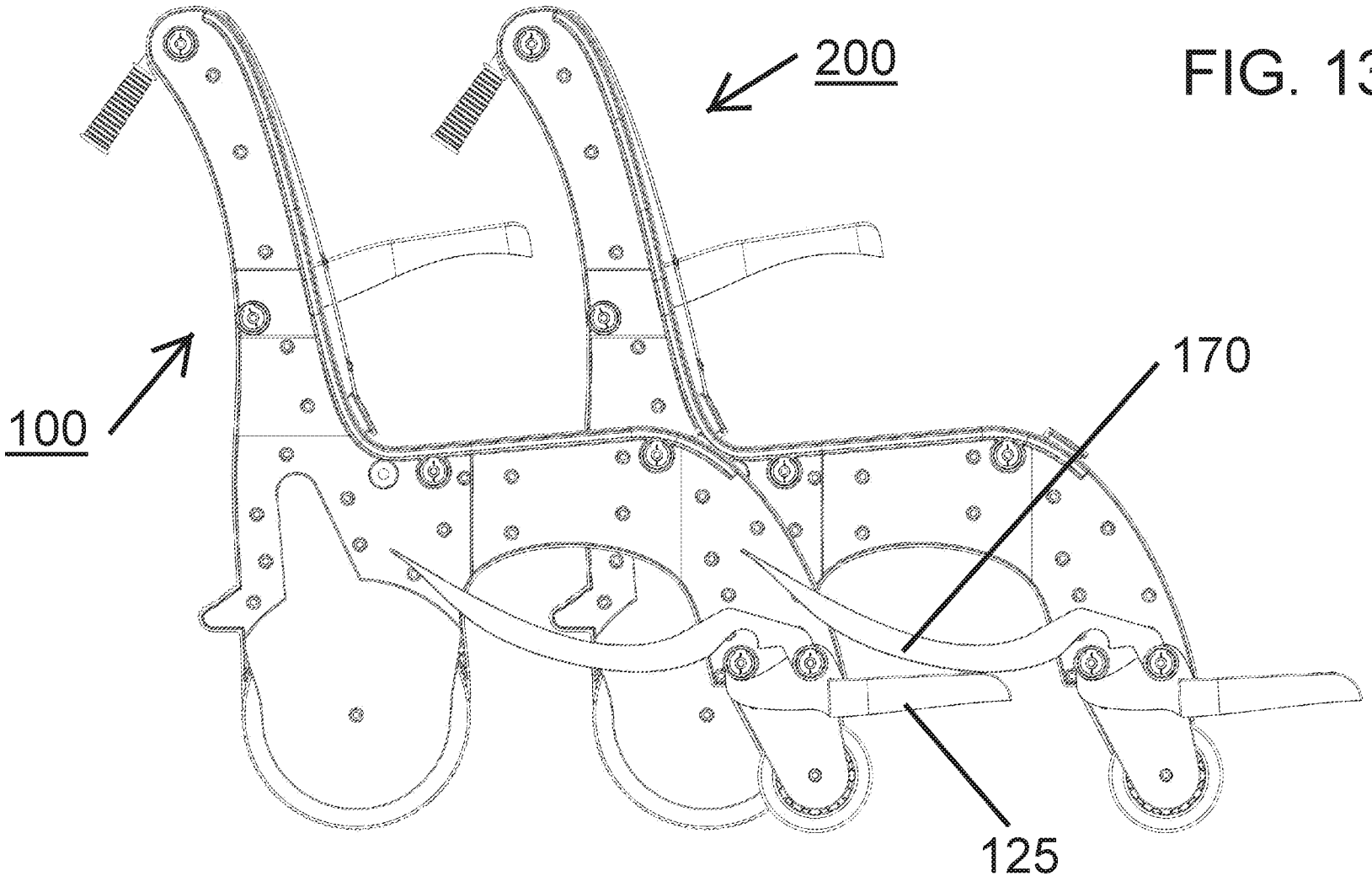
FIG. 13 is a right side view of an embodiment of the present invention.

In some embodiments, the nonmetallic wheelchair 100, 200 may be stackable, as illustrated in FIGS. 10 and 13. The nonmetallic wheelchairs 100, 200 may be configured to be stackable, which is advantageous for saving space and transporting the nonmetallic wheelchairs 100, 200. In some embodiments, the frame 110 may further comprise a left rubber stopper 110*g* and a right rubber stopper 110*h*, as illustrated in FIGS. 3, 9 and 10. The left rubber stopper 110*g* and the right rubber stopper 110*h* act to stabilize and reduce lateral movement when two or more nonmetallic chairs 100, 200 are stacked together. The left rubber stopper 110*g* and the right rubber stopper 110*h* also serve to protect one nonmetallic wheelchair 100 from a second nonmetallic wheelchair 200, as illustrated in FIG. 10. The second nonmetallic wheelchair in FIG. 10 does not have the back section 110*c* and the seat section 110*d* for illustrative and clarity purposes. As illustrated, the left rubber stopper 110*g* of the second nonmetallic wheelchair 200 snugly presses against the main left panel 110*a* of first nonmetallic wheelchair 100. Although not shown, the right rubber stopper 110*h* of the second nonmetallic wheelchair 200 snugly presses against the main right panel 110*b* of first nonmetallic wheelchair 100. This prevents any lateral movement of the first nonmetallic wheelchair 100, which prevents the potential collision damage to the nonmetallic wheelchairs 100, 200. Furthermore, the left rubber stopper 110*g* and the right rubber stopper 110*h* of the second nonmetallic wheelchair 200 prevents the front of the first nonmetallic wheelchair 100 from striking the back of the second nonmetallic wheelchair 200, which also reduces potential collision damage to the nonmetallic wheelchairs 100, 200.

Figure 11:
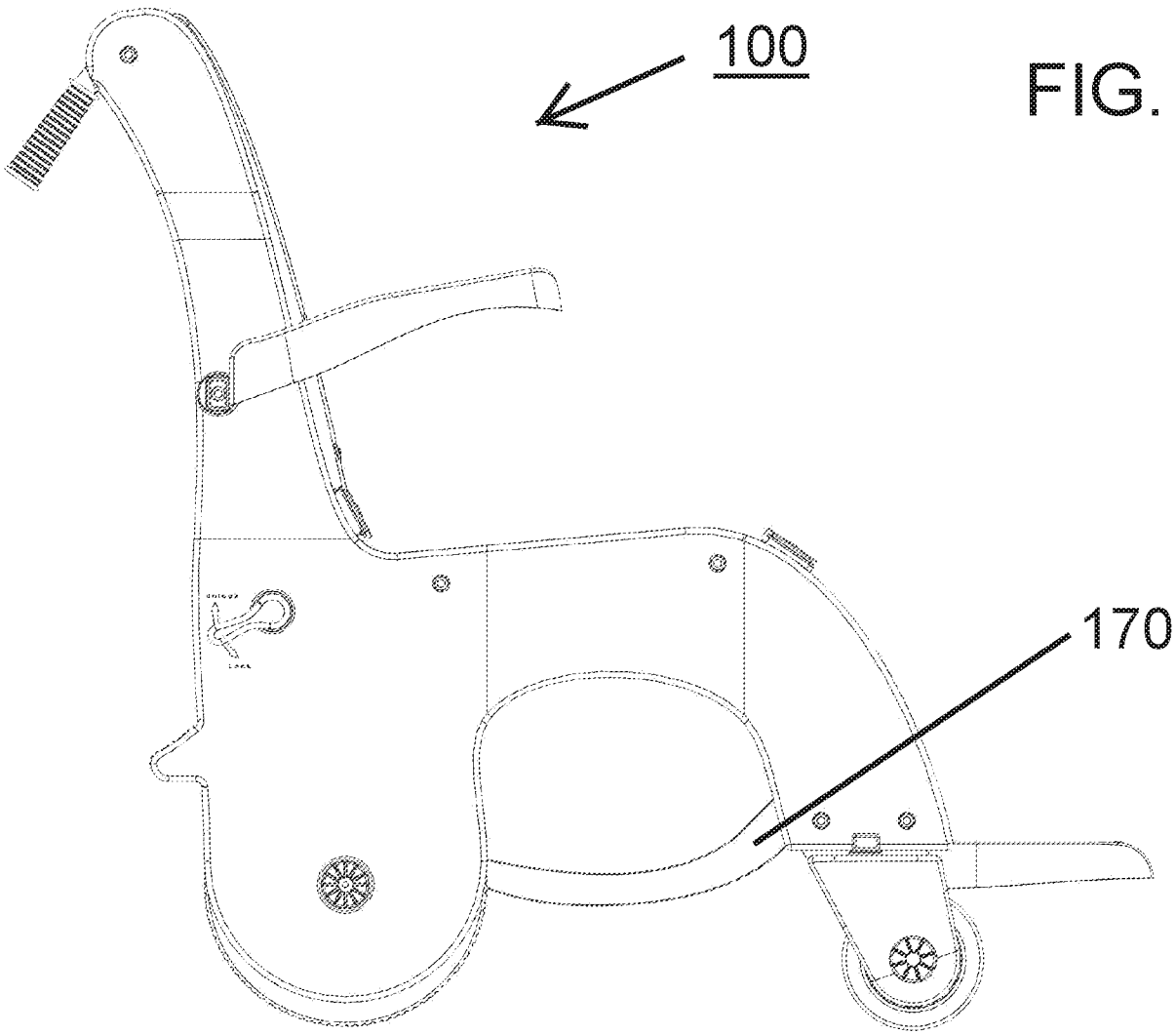
FIG. 11 is a right side view of an embodiment of the present invention.
Figure 12:
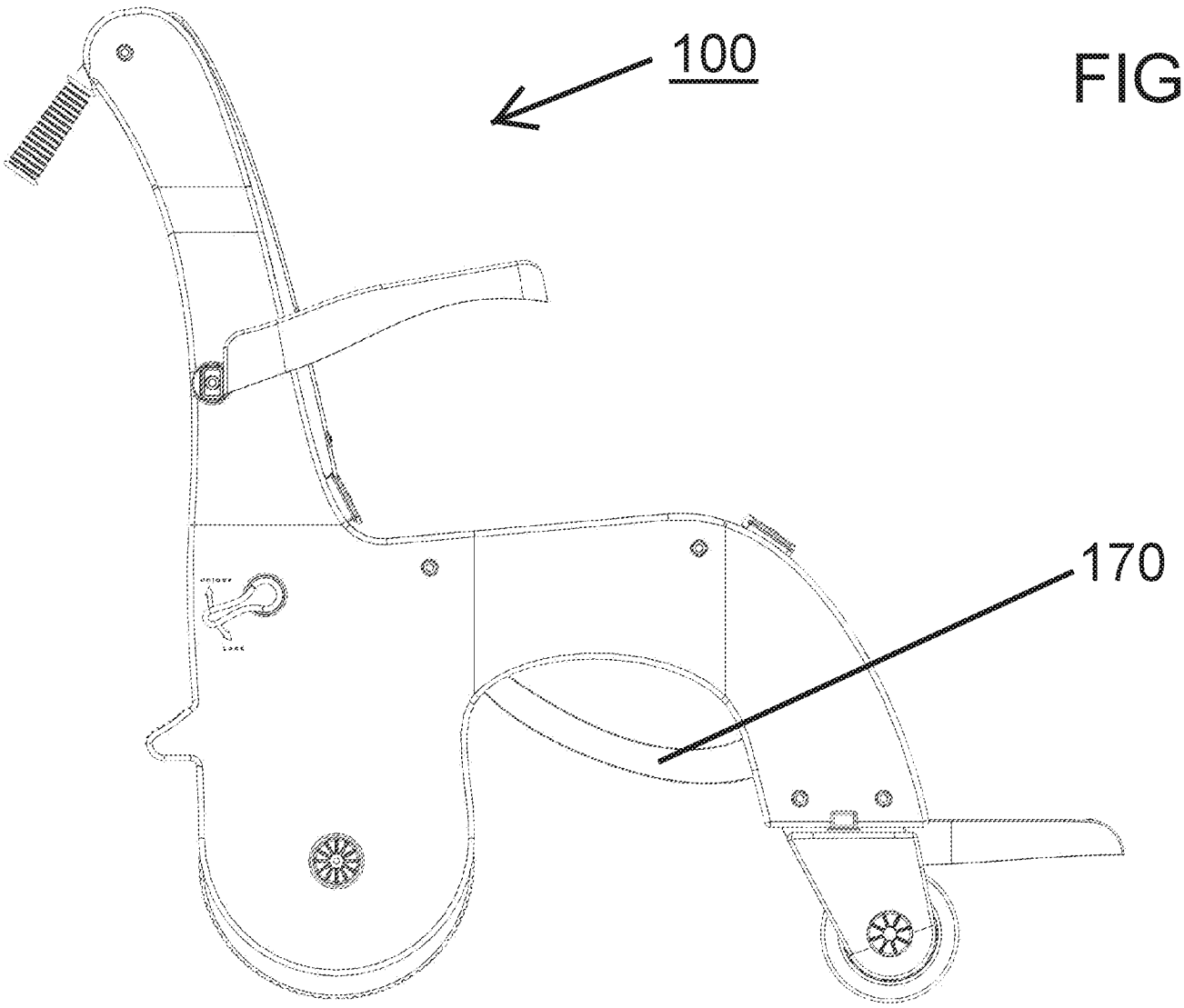
FIG. 12 is a right side view of an embodiment of the present invention.

Additionally, in some embodiments, the baggage tray 170 may be pivoted to facilitate stacking of the nonmetallic wheelchairs 100, 200, as illustrated in FIGS. 11, 12 and 13. FIG. 11 illustrates the baggage tray 170 pivoted in the down position and FIG. 12 illustrates the baggage tray 170 pivoted in the up position. As illustrated in FIG. 13, the first nonmetallic wheelchairs 100 may be stacked with the second nonmetallic wheelchair 200 when the baggage tray 170 of the second nonmetallic wheelchair 200 is pivoted in the up position. The footrest 125 of the first nonmetallic wheelchair 100 may be configured to aid in the stacking by pivoting the baggage tray 170 of the second nonmetallic wheelchair 200 when the first nonmetallic wheelchair 100 is pushed into the back of the second nonmetallic wheelchair 200.

As illustrated in FIGS. 3, 7, 8 and 9, some embodiments may include support rods 110*i* and assembly means 220. The support rods 110*i* may aid the structural integrity of the nonmetallic wheelchair 100. The support rods 110*i* may further assist in pivoting the left armrest 115, the right armrest 120, the footrest 125, and the baggage tray 170. The assembly means 220 may include, but are not limited to, screws, bolts, clamps, and rings. The assembly means 220 may be utilized in the assembly of the nonmetallic wheelchair 100. Like the other parts of the nonmetallic wheelchair 100, the support rods 110*i* and assembly means 220 are nonmetallic, and preferably transparent.

In some embodiments, as illustrated in FIGS. 7 and 8, the nonmetallic wheelchair 100 may be composed of modular parts, thereby allowing ease of repairing or replacing parts. Also, some components may be made of several modular parts, for example, the main left panel 110*a* and the main right panel 110*b* are illustrated in FIGS. 7 and 8 as having at least two modular parts. The figures are illustrative, as the the main left panel 110*a* and the main right panel 110*b* may be manufactured as a single modular part.

In some embodiments, each of the first, second, third, fourth, fifth, sixth, seventh and eighth nonmetallic material may be selected from the group consisting of polycarbonate, rubber, clear rubber, wood, carbon fiber, thermoplastics, clear polycarbonate, tinted polycarbonate, ultraviolet resistant polycarbonate, methyl methacrylate, glass, transparent composites, glass fibers, resins, transparent fiber-reinforced composites, transparent plastic polymers, general purpose polystyrene, styrene acrylonitrile, styrene methyl methacrylate, poly(methyl methacrylate), and combinations thereof. The nonmetallic materials allow the nonmetallic wheelchair 100 to pass through metal detectors without triggering the alarms.

In some embodiments, each of the first, second, third, fourth, fifth, sixth, and seventh nonmetallic material may be polycarbonate. In some embodiments, the polycarbonate may be transparent.

In some embodiments, the eighth nonmetallic material may be clear rubber. In some embodiments, the clear rubber may be transparent.

The term "transparent" may include materials that are transparent and translucent. Generally, objects may have degrees of transparency, from completely transparent to opaque. "Transparent" includes materials that reduce the ability to hide or conceal objects because any hidden or concealed objects will be visible through the transparent materials used in some embodiments of the present invention. This transparency optimizes security.

Thermoplastic polymers include, but are not limited to, grades of thermoplastic polymers that are optically transparent. Examples of optically transparent thermoplastic polymers include, but are not limited to, polycarbonate and methyl methacrylate. Different types of polycarbonate include, but are not limited to, clear polycarbonate, tinted polycarbonate, ultra violet resistant polycarbonate (UV PC). Tinted polycarbonate may be tinted with any color and preferably the tinting maintains the materials' transparency. UV PC may be utilized in applications where the present invention required UV resistance, including, but not limited to, hospital applications.

Methyl methacrylate may also be known as acrylic or acrylic glass. Transparent composites, for example, may be made from nylon and polyacrylonitrile (PAN), where the nylon is embedded into an epoxy matrix and the PAN into poly(methyl methacrylate) (PMMA). Transparent fiber-reinforced composites, include, but are not limited to, mechanically strong composite materials of high optical quality and transparency equivalent to window glass, which may be achieved, for example, by layering a polymer matrix reinforced with glass ribbons and a tough compliant polyurethane film. Transparent plastic polymers, include, but are not limited to, general purpose polystyrene (GPPS), styrene acrylonitrile (SAN), styrene methyl methacrylate (SMMA), and poly(methyl methacrylate).

Embodiments of the present invention preferably utilize nonmetallic materials that are sufficiently strong and rigid, yet lightweight, for this application. As a result, the embodiments are lighter and stronger than standard wheelchairs. Furthermore, the nonmetallic materials are preferably transparent.

Preferably, the embodiments of the present invention may be ergonomically designed for the comfort of the user.

Not all elements in the figures have been labeled for clarity purposes.

While the invention has been described with reference to exemplary embodiments, it will be understood by those skilled in the art that various changes, omissions, and/or additions may be made and equivalents may be substituted for elements thereof without departing from the spirit and scope of the invention. In addition, many modifications may be made to adapt a particular situation or material to the teachings of the invention without departing from the scope thereof. Therefore, it is intended that the invention not be limited to the particular embodiments disclosed as the best mode contemplated for carrying out this invention, but that the invention will include all embodiments falling within the scope of the appended claims. Moreover, unless specifically stated any use of the terms first, second, etc. do not denote any order or importance, but rather the terms first, second, etc. are used to distinguish one element from another.

I claim:

1. A nonmetallic wheelchair comprising:

a frame, wherein the frame comprises:

a main left panel;

a main right panel;

a back section, wherein the back section is coupled to the main left panel and the main right panel; and, a seat section, wherein the seat section is coupled to the main left panel, the main right panel, the back section;

a left armrest, wherein the left armrest is pivotally coupled to the main left panel;

a right armrest, wherein the right armrest is pivotally coupled to the main right panel;

a footrest, wherein the footrest is pivotally coupled to the main left panel and to the main right panel;

a left rear wheel, wherein the left rear wheel is coupled to the main left panel;

a right rear wheel, wherein the right rear wheel is coupled to the main right panel;

a left front wheel, wherein the left front wheel is coupled to the main left panel;

a right front wheel, wherein the right front wheel is coupled to the main right panel;

a left handle, wherein the left handle is coupled to the frame;

a right handle, wherein the right handle is coupled to the frame; and a seatbelt including a seatbelt buckle and a seatbelt adjuster;

wherein the frame, the left armrest, the right armrest, and the footrest are made of a first nonmetallic material;

wherein the seatbelt buckle and the seatbelt adjuster are adapted to adjust the seatbelt to secure a user to the nonmetallic wheelchair;

wherein the seatbelt buckle and the seatbelt adjuster are made of a second nonmetallic material;

wherein the nonmetallic wheelchair is made entirely of nonmetallic materials.

2. The nonmetallic wheelchair of claim 1, wherein the first nonmetallic material is selected from a group consisting of polycarbonate, rubber, clear rubber, wood, carbon fiber, thermoplastics, clear polycarbonate, tinted polycarbonate, ultraviolet resistant polycarbonate, methyl methacrylate, glass, transparent composites, glass fibers, resins, transparent fiber-reinforced composites, transparent plastic polymers, general purpose polystyrene, styrene acrylonitrile, styrene methyl methacrylate, poly(methyl methacrylate), and combinations thereof.

3. The nonmetallic wheelchair of claim 1, wherein the first nonmetallic material is a transparent polycarbonate.

4. The nonmetallic wheelchair of claim 3, wherein the frame further comprises:

a left tipping lever; and, a right tipping lever.

5. The nonmetallic wheelchair of claim 3, wherein the nonmetallic wheelchair is configured to be stackable; and, wherein the frame further comprises:

a left rubber stopper; and, a right rubber stopper.

6. The nonmetallic wheelchair of claim 3, wherein the frame further comprises:

plurality of support rods made of the first nonmetallic material and extending between the left main frame and the right main frame.

7. The nonmetallic wheelchair of claim 1, wherein the second nonmetallic material is selected from a group consisting of polycarbonate, rubber, clear rubber, wood, carbon fiber, thermoplastics, clear polycarbonate, tinted polycarbonate, ultraviolet resistant polycarbonate, methyl methacrylate, glass, transparent composites, glass fibers, resins, transparent fiber-reinforced composites, transparent plastic polymers, general purpose polystyrene, styrene acrylonitrile, styrene methyl methacrylate, poly(methyl methacrylate), and combinations thereof.

8. The nonmetallic wheelchair of claim 1, wherein the second nonmetallic material is polycarbonate.

9. The nonmetallic wheelchair of claim 8, wherein the polycarbonate is transparent.

10. The nonmetallic wheelchair of claim 1 further comprising:

a baggage tray;

wherein the baggage tray is pivotally coupled to the main left panel and to the main right panel; and, wherein the baggage tray is made of a third nonmetallic material.

11. The nonmetallic wheelchair of claim 10, wherein the third nonmetallic material is selected from a group consisting of polycarbonate, rubber, clear rubber, wood, carbon fiber, thermoplastics, clear polycarbonate, tinted polycarbonate, ultraviolet resistant polycarbonate, methyl methacrylate, glass, transparent composites, glass fibers, resins, transparent fiber-reinforced composites, transparent plastic polymers, general purpose polystyrene, styrene acrylonitrile, styrene methyl methacrylate, poly(methyl methacrylate), and combinations thereof.

12. The nonmetallic wheelchair of claim 10, wherein the third nonmetallic material is a transparent polycarbonate.

13. The nonmetallic wheelchair of claim 1, further comprising:

a braking mechanism, wherein the braking mechanism comprises:

a lever;

a connector rod; and, a braking pad;

wherein the lever is pivotally coupled to the connector rod and the connector rod is coupled to the braking pad; and, wherein the lever pivots between a locked position and a released position;

wherein the braking mechanism is nonmetallic and comprises at least one third nonmetallic material; and, wherein the braking pad is in contact with the left rear wheel when the lever is in the locked position.

14. The nonmetallic wheelchair of claim 13, wherein the at least one third nonmetallic material is selected from a group consisting of polycarbonate, rubber, clear rubber, wood, carbon fiber, thermoplastics, clear polycarbonate, tinted polycarbonate, ultraviolet resistant polycarbonate, methyl methacrylate, glass, transparent composites, glass fibers, resins, transparent fiber-reinforced composites, transparent plastic polymers, general purpose polystyrene, styrene acrylonitrile, styrene methyl methacrylate, poly(methyl methacrylate), and combinations thereof.

15. The nonmetallic wheelchair of claim 13, wherein the at least one third nonmetallic material is a transparent polycarbonate.

16. The nonmetallic wheelchair of claim 13, further comprising:

a second braking mechanism, wherein the second braking mechanism comprises:

a second lever;

a second connector rod; and, a second braking pad;

wherein the second lever is coupled to the second connector rod and the second connector rod is coupled to the second braking pad; and, wherein the second lever pivots between a second locked position and a second released position;

wherein the second braking mechanism is nonmetallic and comprises at least one fourth nonmetallic material; and, wherein the second braking pad is in contact with the right rear wheel when the second lever is in the second locked position.

17. The nonmetallic wheelchair of claim 16, wherein the at least one fourth nonmetallic material is selected from a group consisting of polycarbonate, rubber, clear rubber, wood, carbon fiber, thermoplastics, clear polycarbonate, tinted polycarbonate, ultraviolet resistant polycarbonate, methyl methacrylate, glass, transparent composites, glass fibers, resins, transparent fiber-reinforced composites, transparent plastic polymers, general purpose polystyrene, styrene acrylonitrile, styrene methyl methacrylate, poly(methyl methacrylate), and combinations thereof.

18. The nonmetallic wheelchair of claim 16, wherein the at least one fourth nonmetallic material is a transparent polycarbonate.

19. The nonmetallic wheelchair of claim 1, wherein the left rear wheel, the right rear wheel, the left front wheel, the right front wheel, the left handle, and the right handle are made of a third nonmetallic material.

20. The nonmetallic wheelchair of claim 19, wherein the third nonmetallic material is selected from a group consisting of polycarbonate, rubber, clear rubber, wood, carbon fiber, thermoplastics, clear polycarbonate, tinted polycarbonate, ultraviolet resistant polycarbonate, methyl methacrylate, glass, transparent composites, glass fibers, resins, transparent fiber-reinforced composites, transparent plastic polymers, general purpose polystyrene, styrene acrylonitrile, styrene methyl methacrylate, poly(methyl methacrylate), and combinations thereof.

21. The nonmetallic wheelchair of claim 19, wherein the third nonmetallic material is polycarbonate.

22. The nonmetallic wheelchair of claim 21, wherein the polycarbonate is transparent.

23. The nonmetallic wheelchair of claim 1 further comprising:

a plurality of radial ball bearings, wherein the plurality of radial ball bearings are made of a third nonmetallic material.

24. The nonmetallic wheelchair of claim 23, wherein the third nonmetallic material is selected from a group consisting of polycarbonate, rubber, clear rubber, wood, carbon fiber, thermoplastics, clear polycarbonate, tinted polycarbonate, ultraviolet resistant polycarbonate, methyl methacrylate, glass, transparent composites, glass fibers, resins, transparent fiber-reinforced composites, transparent plastic polymers, general purpose polystyrene, styrene acrylonitrile, styrene methyl methacrylate, poly(methyl methacrylate), and combinations thereof.

25. The nonmetallic wheelchair of claim 23, wherein the third nonmetallic material is polycarbonate.

26. The nonmetallic wheelchair of claim 25, wherein the polycarbonate is transparent.

27. The nonmetallic wheelchair of claim 1 further comprising:

a left grip, wherein the left grip is coupled to the left handle; and, a right grip, wherein the right grip is coupled to the right handle;

wherein the left grip and the right grip are made of a third nonmetallic material.

28. The nonmetallic wheelchair of claim 27, wherein the third nonmetallic material is selected from a group consisting of polycarbonate, rubber, clear rubber, wood, carbon fiber, thermoplastics, clear polycarbonate, tinted polycarbonate, ultraviolet resistant polycarbonate, methyl methacrylate, glass, transparent composites, glass fibers, resins, transparent fiber-reinforced composites, transparent plastic polymers, general purpose polystyrene, styrene acrylonitrile, styrene methyl methacrylate, poly(methyl methacrylate), and combinations thereof.

29. The nonmetallic wheelchair of claim 27, wherein the third nonmetallic material is a transparent rubber.

30. The nonmetallic wheelchair of claim 1, further comprising:

a kneestrap including a kneestrap buckle and a kneestrap adjuster;

wherein the kneestrap buckle and the kneestrap adjuster are adapted to adjust the kneestrap to secure the user to the nonmetallic wheelchair; and wherein the kneestrap buckle and the kneestrap adjuster are made of the second nonmetallic material.

31. A nonmetallic wheelchair, comprising:

a nonmetallic frame including a left panel, a right panel, a plurality of support rods connecting the left panel and the right panel, a back section, and a seat section;

a nonmetallic left armrest coupled to the left panel;

a nonmetallic right armrest coupled to the right panel;

a nonmetallic footrest pivotably coupled about a first one of the plurality of support rods;

a plurality of nonmetallic wheels rotatably coupled to the frame; and at least one nonmetallic handle coupled to the frame;

wherein the frame, the left armrest, the right armrest, and the footrest are made of a transparent nonmetallic material;

wherein the nonmetallic wheelchair is made entirely of nonmetallic materials.

32. The nonmetallic wheelchair of claim 31, further comprising a nonmetallic seatbelt including a nonmetallic seatbelt buckle.

33. The nonmetallic wheelchair of claim 31, wherein the transparent nonmetallic material is a transparent polycarbonate.

34. The nonmetallic wheelchair of claim 31, further comprising:

a baggage tray below the seating section and made of the transparent nonmetallic material.

35. The nonmetallic wheelchair of claim 34, wherein the baggage tray is pivotably coupled about the first one of the plurality of rods.

36. The nonmetallic wheelchair of claim 35, wherein the baggage tray is pivotable between a lowered position for receiving baggage and a raised position, wherein the nonmetallic wheelchair is configured to stack with a second nonmetallic wheelchair when the baggage tray is in the raised position without removing any component of the nonmetallic wheelchair.

37. The nonmetallic wheelchair of claim 31, further comprising:

a nonmetallic braking mechanism including a nonmetallic lever and a nonmetallic braking pad.

* * * * *